US006618974B2

(12) United States Patent
Szalay

(10) Patent No.: US 6,618,974 B2
(45) Date of Patent: Sep. 16, 2003

(54) MESSAGE DISPLAY APPARATUS

(76) Inventor: David E. Szalay, P.O. Box 424, Richfield, OH (US) 44286

( * ) Notice: Subject to any disclaimer, the term of this patent is extended or adjusted under 35 U.S.C. 154(b) by 0 days.

(21) Appl. No.: 09/821,934

(22) Filed: Mar. 30, 2001

(65) Prior Publication Data

US 2001/0045038 A1 Nov. 29, 2001

Related U.S. Application Data

(60) Provisional application No. 60/196,363, filed on Apr. 12, 2000.

(51) Int. Cl.[7] ..... G09F 7/02
(52) U.S. Cl. ..... 40/611; 40/765
(58) Field of Search ..... 40/611, 765, 766, 40/768, 642.02, 649

(56) References Cited

U.S. PATENT DOCUMENTS

| | | | | | |
|---|---|---|---|---|---|
| 4,337,590 | A | * | 7/1982 | Jackson | 40/615 |
| D284,392 | S | | 6/1986 | Weil | |
| 4,821,440 | A | | 4/1989 | Dunn | |
| 4,828,502 | A | | 5/1989 | Leahy | |
| D322,529 | S | | 12/1991 | Zajac | |
| 5,078,093 | A | * | 1/1992 | Flaherty | 119/256 |
| 5,083,925 | A | | 1/1992 | Maruyama | |
| 5,137,453 | A | | 8/1992 | Hudson | |
| 5,163,845 | A | * | 11/1992 | Blassingame | 434/247 |
| 5,176,522 | A | | 1/1993 | Robertson, Jr. | |
| 5,263,866 | A | | 11/1993 | Campbell | |
| 5,324,202 | A | | 6/1994 | Meyers et al. | |
| 5,382,562 | A | | 1/1995 | Hutten | |
| 5,422,155 | A | | 6/1995 | Spence, Jr. | |
| 5,457,905 | A | | 10/1995 | Kaplan | |
| 5,472,239 | A | | 12/1995 | Trujillo | |
| 5,623,778 | A | | 4/1997 | Dunn | |
| 5,626,478 | A | | 5/1997 | Gatlin | |
| 5,664,851 | A | | 9/1997 | Dunn | |
| 5,727,952 | A | | 3/1998 | Schenck et al. | |
| 5,732,978 | A | | 3/1998 | Tunnell, IV | |
| D400,930 | S | | 11/1998 | Smith | |

* cited by examiner

*Primary Examiner*—S. Joseph Morano
*Assistant Examiner*—Robert J. McCarry, Jr.
(74) *Attorney, Agent, or Firm*—Hahn Loeser & Parks, LLP; W. Edward Crooks

(57) ABSTRACT

The present invention is a message display apparatus that is preferably weather resistant. The present invention is comprised of a pair of parallel side frame members attached at their ends to a bottom frame member. The side frame members are also adapted to receive a pair of covers where at least one of the covers is visibly clear. The clear cover allows a message board to be displayed while simultaneously protecting it from poor weather. Additionally, a top frame member is attached to the message board so that it can be easily inserted into and removed from the message display apparatus.

25 Claims, 2 Drawing Sheets

FIG. 2
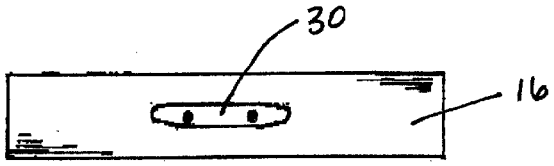
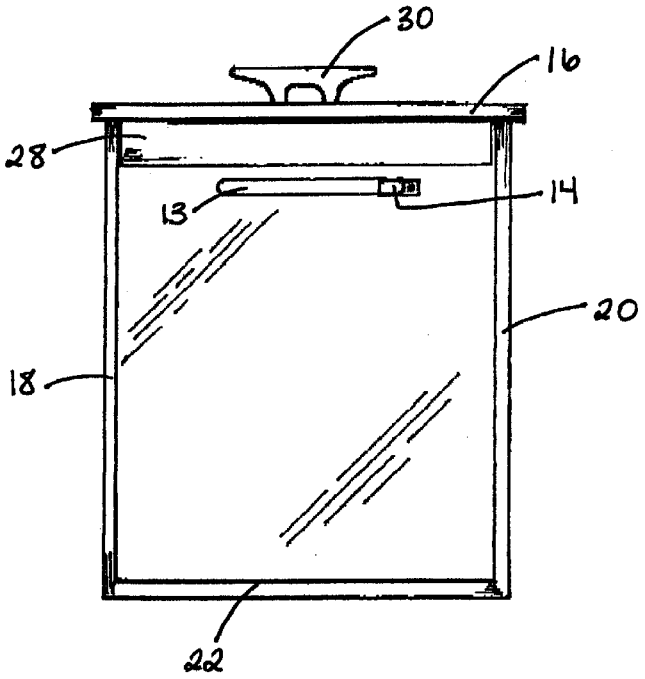
FIG. 3
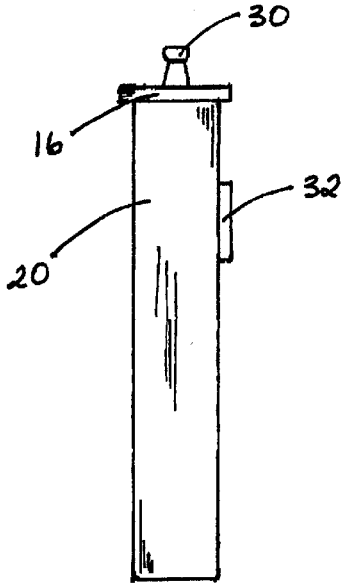
FIG. 4

MESSAGE DISPLAY APPARATUS

This application claims the benefit of U.S. Provisional Application No. 60/196,363 filed on Apr. 12, 2000. The present invention relates to a message display apparatus. More specifically, the present invention is a weather resistant message display apparatus for storing float plans and other information.

TECHNICAL FIELD

BACKGROUND OF THE INVENTION

The U.S. Coast Guard recommends that boaters file float plans before going sailing, fishing, or boating. A float plan is a trip itinerary designed to assist others in locating boaters in case of an emergency. Float plans typically contain information such as a description of the vessel, the expected route, ports of call, estimated date and time of return, etc. A float plan allows others to determine whether a boater may be in trouble and provides information helpful to local police or the Coast Guard for locating the boaters.

However, most boaters do not consider making a float plan until reaching the yacht club or marina. Further, float plans written on ordinary paper must be taken to the yacht club or marina for safekeeping and then upon return, the float plan must be closed-out. This also requires keeping blank float plans on the boat for such use. Due to these inconveniences, most boaters tend not to take the time to fill out and post a float plan. This is so despite the fact that taking the time to do so can save lives.

Float plans are an essential safety precaution which should be performed by all boaters. Thus, there is a need for an efficient way to create and preserve float plans for boaters.

SUMMARY OF THE INVENTION

The message display apparatus of the present invention is designed to provide boaters with a simple and efficient way to create float plans and other information, and at the same time display and protect the information from poor weather and the elements.

The present invention comprises a message board retained within a frame. The frame is comprised of a pair of parallel side frame members attached at their respective ends to a bottom frame member. The pair of side frame members are also adapted to receive a pair of covers, where at least one of the covers is visibly clear. Additionally, a top frame member is attached to the message board so the message board may be slideably inserted into the frame for display.

More particularly, the message board is connected to the top frame member via a board support. The board support provides a sturdy connection between the top frame member and the message board.

BRIEF DESCRIPTION OF THE DRAWINGS

FIG. 2 is a top plan view of the top frame member of the message display apparatus of the present invention;

FIG. 3 is a front elevational view of the message display apparatus of the present invention; and FIG. 4 is a side plan view of the message display apparatus of the present invention.

DETAILED DESCRIPTION OF THE INVENTION

Figure 1:
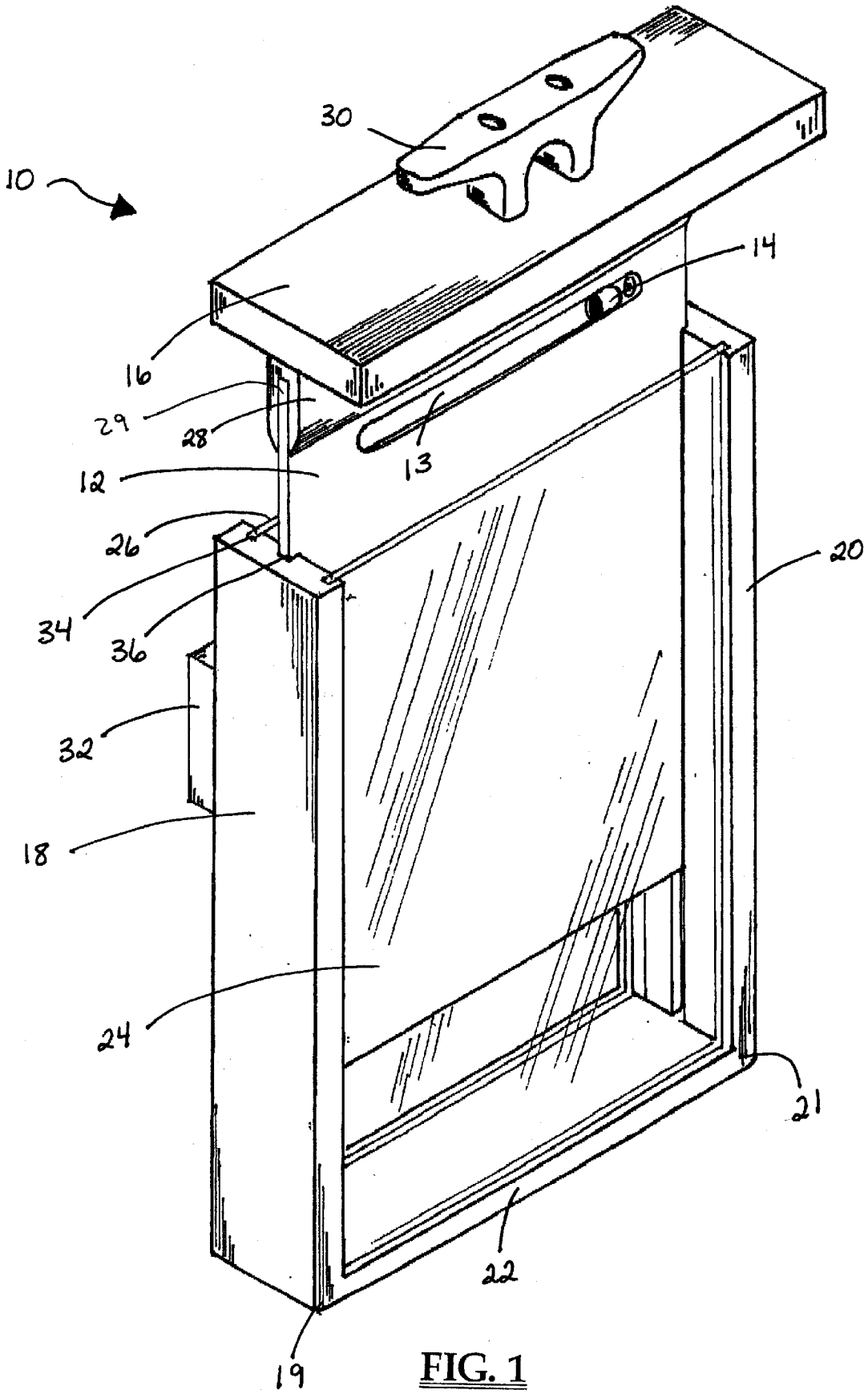
FIG. 1 is a front perspective view of the message display apparatus of the present invention.

In the following detailed description of the present invention, reference is made to the accompanying drawings which, in conjunction with this detailed description, illustrate and describe an apparatus which gives boaters a simple and efficient method to communicate information and messages, which are protected from the elements.

FIG. 1 illustrates the message display apparatus 10 of the present invention. The message display apparatus 10 is comprised of two side frame members 18 and 20, which are secured at their respective ends 19 and 21 to a bottom frame member 22. The side frame members 18 and 20 are also adapted to receive covers 24 and 26. Cover 24 faces the front of the message display apparatus 10 and so is fabricated from a visibly clear material such as glass, plastic and polymer. In a preferred embodiment, both covers 24 and 26 are fabricated from a visibly clear material. Covers 24 and 26 are then fastened within the side frame members 18 and 20 thereby creating a U-shaped frame enclosure.

The side frame members 18 and 20 include slots or grooves to receive covers 24 and 26. In a preferred embodiment, covers 24 and 26 are inserted into slots 34 but they may also be molded directly to the side frame members 18 and 20. In a preferred embodiment, the side frames members 18 and 20 also include a slot or groove which releasably receives message board 12. The message board 12 can either be releaseably inserted into slots 36 or retained loosely within the U-shaped frame enclosure formed by side frame members 18 and 20 and bottom frame member 22.

The message board 12 is attached to a top frame member 16. In a preferred embodiment, the top frame member 16 is larger then the bottom frame member 22 so that the top frame member 16 provides a weather resistant cover when placed over the U-shaped enclosure. The message board 12 is inserted into the open end of the U-shaped enclosure until the top frame member 16 rests on and overlaps the side frame members 18 and 20 and the covers 24 and 26.

In a preferred embodiment, the message board 12 is attached to the top frame member 16 by a board support 28. The board support 28 is a longitudinally extending member mounted to the bottom of the top frame member 16. The board support 28 includes a slot 29 or groove running the length of the board support 28. The message board 12 is inserted within the slot 29 formed in the board support 28, where it is mounted using glue, screws or any other means of maintaining the message board 12 within the slot 29 of the board support 28. The board support 28 provides a sturdy connection between the top frame member 16 and the message board 12.

In a preferred embodiment, the message board 12 includes an aperture 13 to receive a writing device, such as a marker or pen, for storage. The writing device aperture 13 further comprises a releasable holder 14 attached to one end of the aperture 13. The marker or other writing device is then secured to the message board 12 using the holder 14. In a preferred embodiment, the holder 14 is comprised of a portion of flexible tubing with one end pinched together and mounted to the message board 12 at one end of the aperture 13. The other end of the flexible tubing extends longitudinally with the aperture 13 to receive one end of a writing device. The writing device is then held within the aperture 13 by the holder 14 for easy removal and replacement by the user. The combination of the writing aperture 13 and the holder 14 provide a convenient storage mechanism that ensures boaters or others will always be able to fill out a float plan. A person of ordinary skill in the art would understand that a writing device could be maintained with the message board 12 or the message display apparatus 10 in a multitude of ways, including without limitation the use of chains, string, hook and loop fasteners, or temporary adhesives. For example, the message board 12 could include the releasable holder 14 coupled directly to the message board 12 without the aperture 13 formed within the message board 12.

Referring to FIG. 2, in a preferred embodiment the top frame member 16 includes a handle 30. The handle 30 enables the message board 12 to be easily removed from the U-shaped enclosure. Referring to FIG. 4, the message display apparatus 10 includes at least one mounting support 32 attached to the back of the U-shaped enclosure. In a preferred embodiment, separate mounting supports 32 are each coupled to one of the side frame members 18 and 20. In use, the message display apparatus 10 is fastened to a structure, such as a dock box or a pole on the dock, using the mounting supports 32 in order to prominently display the message board 12 within the U-shaped enclosure.

In a preferred embodiment, the bottom frame member 22, the top frame member 16, and the side frame members 18 and 20 are fabricated from a plastic or polymer material. Additionally, covers 24 and 26 are fabricated from clear plastic. It should be understood that any number of other materials could be used to fabricate or form these components but the use of plastic or polymer provides the message display apparatus 10 with significant weather resistant qualities.

In addition, information that is of a more permanent nature can be printed or applied by vinyl lettering and/or stickers directly to the message board 12. The remainder of the message board 12 can be used as a dry-erase marker board so that messages and information can be easily made and changed.

Although the principles, preferred embodiments and preferred operation of the present invention have been described in detail herein, this is not to be construed as being limited to the particular illustrative forms disclosed. It will thus become apparent to those skilled in the art that various modifications of the preferred embodiments herein can be made without departing from the spirit or scope of the invention as defined by the appended claims.

What is claimed is:

1. A message display apparatus comprising:

a message board having a writing surface;

a non-perforated top frame member attached to said message board;

a bottom frame member;

a pair of parallel side frame members attached at their respective ends to said bottom frame member; and at least one visibly clear cover, wherein said pair of side frame members receive said at least one clear cover; and wherein said message board is releasably inserted behind said at least one clear cover.

2. A message display apparatus as recited in claim 1, wherein said top, bottom, and side frame members are comprised of a material selected from the group consisting of plastic, polymer, metal, aluminum, wood, and ceramic.

3. A message display apparatus as recited in claim 1, wherein said at least one clear cover is comprised of a material selected from the group consisting of glass, plastic and polymer.

4. A message display apparatus as recited in claim 1, wherein said bottom and side frame members include slots to receive said at least one clear cover.

5. A message display apparatus as recited in claim 4, wherein said side frame members include slots to receive said message board.

6. A message display apparatus as recited in claim 1, wherein said message board is attached to said top frame member by a board support.

7. A message display apparatus as recited in claim 1, wherein said top frame member includes a handle.

8. A message display apparatus as recited in claim 1, wherein said message board includes an aperture for receiving a writing device.

9. A message display apparatus as recited in claim 8, wherein said aperture includes a holder attached to one end of said aperture.

10. A message display apparatus as recited in claim 9, wherein said holder is comprised of a portion of flexible tubing.

11. A message display apparatus as recited in claim 1, wherein said message board includes a releasable holder.

12. A message display apparatus as recited in claim 11, wherein said releasable holder is comprised of a portion of flexible tubing.

13. A message display apparatus as recited in claim 1, further comprising at least one mounting support attached to said message display apparatus.

14. A weather-resistant message display apparatus comprising:

a message board having a writing surface;

a non-perforated top frame member attached to said message board;

a bottom frame member;

a pair of side frame members attached at their respective ends to said bottom frame member;

a front cover attached to said side members; and a back cover attached to said side members, wherein at least one of said covers is visibly clear, and said message board is releasably inserted behind said at least one clear cover.

15. A weather-resistant outdoor message display apparatus, comprising:

a message board attached to a non-perforated frame member, the message board having a writing surface; and a receptacle having a plurality of sides and an open top; wherein, at least one of the sides is substantially transparent, the message board is releasably inserted within the receptacle, and wherein, the frame member covers the open top and encloses the message board within the receptacle.

16. The weather-resistant message display apparatus as recited in claim 15, wherein the message board is erasable.

17. The weather-resistant message display apparatus as recited in claim 15, wherein the frame member and the receptacle collectively define an enclosed interior space.

18. The weather-resistant message display apparatus as recited in claim 17, wherein the writing surface is in direct contact with ambient air of the enclosed interior space.

19. The weather-resistant message display apparatus as recited in claim 15, wherein the frame member includes a handle.

20. The weather-resistant message display apparatus as recited in claim 15, wherein the message board has an aperture for receiving a writing device.

21. The weather-resistant message display apparatus as recited in claim 20, wherein the aperture includes a holder attached to one end of the aperture, the holder adapted to attach the writing device.

22. The weather-resistant message display apparatus as recited in claim 21, wherein the holder is comprised of a portion of flexible tubing.

23. The weather-resistant message display apparatus as recited in claim 15, further comprising at least one mounting support attached to the receptacle.

24. The weather-resistant message display apparatus as recited in claim 15, wherein the frame member extends beyond the at least one transparent side of the receptacle.

25. A method of displaying a message and protecting the message, comprising the steps of:

writing a message on a message board attached to a non-perforated frame member;

inserting the message board within a receptacle having a plurality of sides and an open top; wherein, when the message board is inserted into the receptacle, the frame member covers the open top and substantially prevents water from entering the receptacle; and displaying the message.

* * * * *